US005302341A

United States Patent [19]

Palowitz et al.

[11] Patent Number: 5,302,341

[45] Date of Patent: Apr. 12, 1994

[54] CONTINUOUS METHOD FOR FORMATION OF BRIQUETTES CONTAINS LESS THAN 1% BINDER BY WEIGHT OF THE BRIQUETTE

[75] Inventors: Francis S. Palowitz, Boardman; Sudarshan R. Sathe, Canfield, both of Ohio

[73] Assignee: Palsat International, Inc., Boardman, Ohio

[21] Appl. No.: 968,386

[22] Filed: Oct. 29, 1992

[51] Int. Cl.[5] ..... B22F 1/00

[52] U.S. Cl. ..... 419/65; 419/66; 75/767; 75/772; 75/755

[58] Field of Search ..... 75/767, 772, 755; 419/65, 66

[56] References Cited

U.S. PATENT DOCUMENTS

| | | | |
|---|---|---|---|
| 3,870,666 | 3/1975 | Becker | 260/21 |
| 4,079,031 | 3/1978 | Sardessai et al. | 164/16 |
| 4,311,631 | 1/1982 | Myers et al. | 523/143 |
| 4,381,813 | 5/1983 | Kottke | 164/527 |
| 4,497,661 | 2/1985 | Valenti | 75/256 |
| 4,615,372 | 10/1986 | Kopac et al. | 524/442 |
| 5,082,876 | 1/1992 | Iyer et al. | 523/145 |
| 5,089,540 | 2/1992 | Armbruster et al. | 523/213 |
| 5,182,346 | 1/1993 | Gerber | 525/503 |

*Primary Examiner*—Donald P. Walsh

*Assistant Examiner*—Anthony R. Chi

*Attorney, Agent, or Firm*—Fay, Sharpe, Beall, Fagan, Minnich & McKee

[57] ABSTRACT

The subject invention relates to method for briquetting fines and ultrafines comprising mixing the fines and ultrafines on a continuous basis with a binder system having low viscosity of up to about 200 cps and at least 50% solids, such that the resulting briquette contains less than about 3% binder by weight of the briquette.

The invention further relates to a process for producing briquettes from fines and/or pretreated ultrafines comprising discharging the fines and/or pretreated ultrafines into a high speed mixer; discharging the components of a binder system into the high speed mixer through fog nozzles simultaneously with the discharge of the fines and/or pretreated ultrafines; agitating the binder and the material to produce a homogeneous binder-fines-ultrafines mixture; discharging the homogeneous binder-fines-ultrafines mixture into a delay box for a period of time such that the mixture is at the point of incipient cure; discharging the mixture at the point of incipient cure into a briquetting press and forming briquettes therefrom; discharging the briquettes onto a heated conveyor for a period of not longer than 4 minutes to cure the briquettes, and collecting the cured briquettes.

16 Claims, 1 Drawing Sheet

CONTINUOUS METHOD FOR FORMATION OF BRIQUETTES CONTAINS LESS THAN 1% BINDER BY WEIGHT OF THE BRIQUETTE

BACKGROUND OF THE INVENTION

The subject invention is directed to a process for producing briquettes from the fines produced by metallurgical processes wherein less than 3% by weight of the briquette formed, is the binder material. Also disclosed is a process description comprising proper sequencing and juxtapositioning of various apparatus for producing such briquettes.

Solids handling is a major part of a variety of processes, especially metallurgical processes. Size degradation inevitably occurs during handling, resulting in the creation of "fines" (a generic term generally used for particles that are smaller than ¼"). Fines are produced in a variety of other ways as well. Due to the small particle size which vitiates recoveries, and associated problems with handling, fines in the unagglomerated state cannot be remuneratively used. Many metallurgical processes today are generating ultrafine baghouse dusts that are listed as hazardous wastes by EPA, and must be disposed of at considerable cost. These costs are going to be higher as the number of disposal sites shrinks and regulations become even more demanding. Consequently, there is great interest in the industry to somehow avert these disposal costs and perhaps reduce the waste streams through recycling. The baghouse dusts, because of their ultrafine size, are not amenable to briquetting by the standard methods available to date. This invention will relate a way of briquetting these fines, among other things.

Agglomeration of fines to make them more usable has been a common practice for more than 100 years. One method of agglomeration is to use binders. The most commonly used binders include sodium silicate, a lime and molasses combination, Portland cement and water, and steric acid, among others. These binders typically make up about 10% by weight of the final product; and agglomeration is generally a batch process.

Briefly, binder components and the fines are delivered into typical mixing equipment and the mixture is stirred together for a certain length of time to produce a homogeneous mix. No particular attention is paid to the particle size of the binder components as they are delivered into the fines. However, it is known that the surface area of the binder should ideally be greater than or equal to the surface area of the fines. Thus, any binding process involves a basic surface area balance. Since the binder is a relatively minor part of the agglomerate by weight, it becomes clear that to create the same surface area out of the binder as that of a much larger amount by weight, of particulates, is quite a challenge. The typical way of delivering the binder to the mix necessarily requires that a considerable amount of binder be used.

But one cannot keep adding the binder indefinitely. After all, there is a common sense upper limit on the binder percentage for the mixture to be economically viable. The process, due to the batch nature, is forced to stop at a certain binder percentage which in most cases is not really enough to produce a high quality agglomerate. Consequently, typical binder systems produce an agglomerate with poor green strength ( i.e. the strength necessary to hold the agglomerate in a given form or shape after partial curing) which is insufficient for maintaining that form or shape during handling and transportation of the resulting briquettes. Typically, such agglomerates are post cured with heat, followed by a curing time of about 24 hours before the agglomerates can be handled or transported. Thus, storage must be made available to accommodate the agglomerates during this long cure period. When such agglomerates are eventually used in the process, high binder content results in excessive energy costs to break the binder down and the inorganic binder residue becomes an impurity.

Some three-part organic binder systems, including one that claims to use a relatively low binder percentage compared to the standard inorganic binder, have recently been offered. However, these systems use lead based catalysts leading to high lead content and also a high level of free formaldehyde, both of which are considered to be hazardous to health. These systems are known to contain a solvent package that poses potential health and environmental hazards as well. Further, these systems comprise a high viscosity resin (over 250 cps) impeding the resin's ability to produce small enough particles that are necessary to achieve the required surface area balance. For these reasons, these binder systems would be unattractive to the Industry.

The following invention relates to bonding fine particles and agglomerating these particles on a continuous basis by using an uncommonly low quantity of binder, i.e. less than about 3%. The binder is organic in nature and can burn off completely, leaving no residue. The low quantity of binder substantially maintains the original chemistries, i.e. the percentage breakdown of most or all of the components or elements in the original fines is almost unchanged. Also, the low quantity of binder saves handling and transportation costs, and saves on energy costs as the agglomerated material is economical in various energy consuming processes.

Therefore, it is an object of this invention to provide a means by which metallurgical fines can be agglomerated with lesser amounts of binder while at the same time producing an agglomerate with sufficient strength to undergo handling, transportation, and use without untimely degradation of the material.

It is a further object of the invention to provide a binder system, devoid of carcinogens or other potentially hazardous components, for the agglomeration of fines.

In addition, this invention will present a way of agglomerating ultrafine dusts such as electric arc furnace dust or basic oxygen furnace baghouse dust, among others.

Finally, it is an object of the invention to provide a continuous agglomeration process which avoids the need for lengthy cure times and thus for holding or storage accommodation.

SUMMARY OF THE INVENTION

The subject invention relates to method for briquetting fines and ultrafines comprising mixing the fines and ultrafines on a continuous basis with a binder system having low viscosity of up to about 200 cps and at least 50% solids, such that the resulting briquette contains less than about 3% binder by weight of the briquette.

The invention further relates to a process for producing briquettes from fines and/or pretreated ultrafines comprising discharging the fines and/or pretreated ultrafines into a high speed mixer; discharging the components of a binder system into the high speed mixer through fog nozzles simultaneously with the discharge of the fines and/or pretreated ultrafines; agitating the binder and the material to produce a homogeneous binder-fines-ultrafines mixture; discharging the homogeneous binder-fines-ultrafines mixture into a delay box for a period of time such that the mixture is at the point of incipient cure; discharging the mixture at the point of incipient cure into a briquetting press and forming briquettes therefrom; discharging the briquettes onto a heated conveyor for a period of not longer than 4 minutes to cure the briquettes, and collecting the cured briquettes.

DETAILED DESCRIPTION OF THE INVENTION

Figure 1:
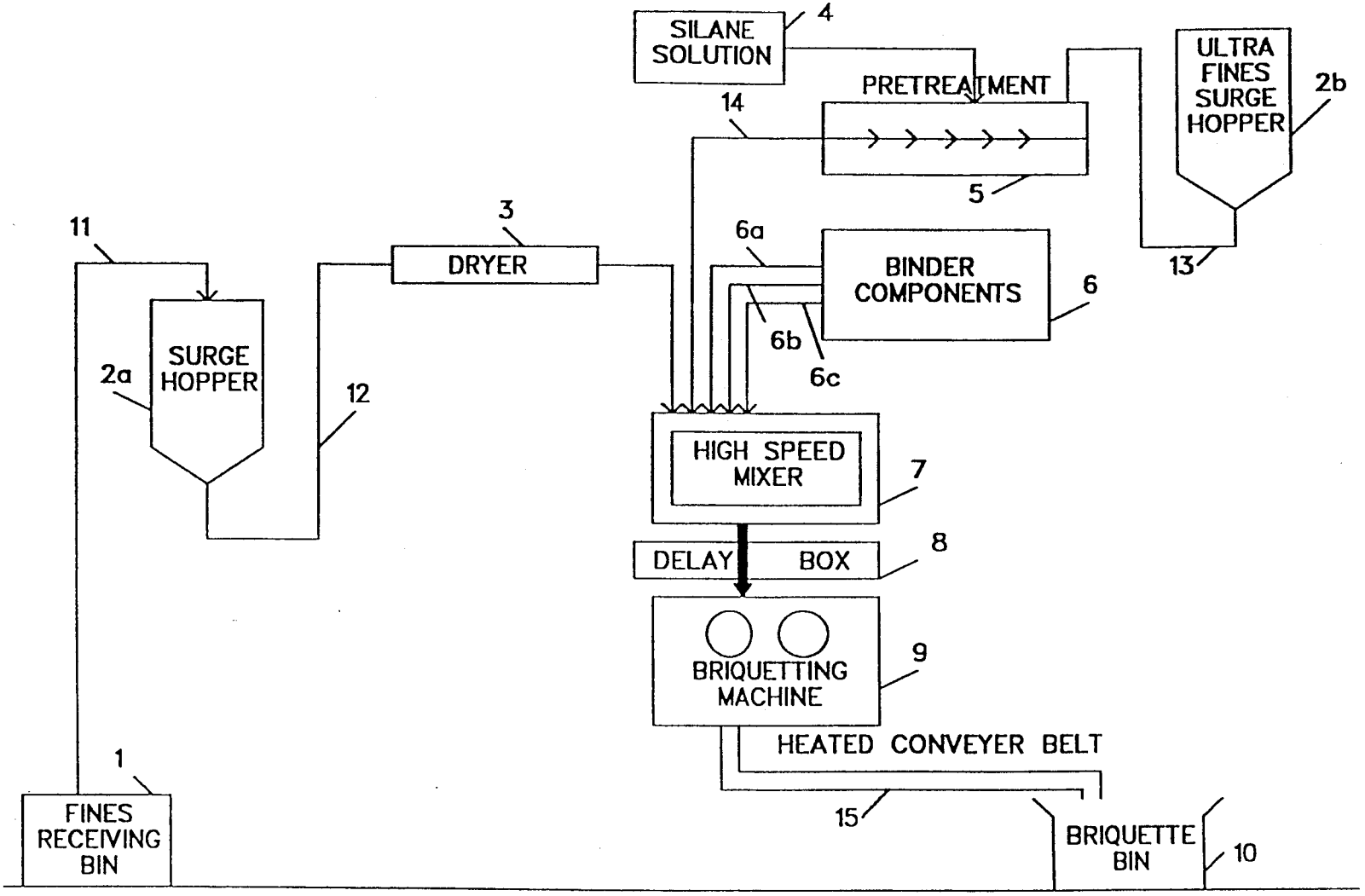
FIG. 1 represents a schematic diagram of the equipment sequence used to achieve briquetting of fines and ultrafines according to the subject invention.

The subject invention relates in general to a method for briquetting industrial fines. More specifically, the invention disclosed herein relates to a binder system to be used in the briquetting process, to the process itself and to the equipment used to carry out the process. For ease of understanding, the following discussion is divided into sections relating to each of the foregoing areas.

Processing

The present invention is a continuous process for producing briquettes from fines by use of a three part thermosetting polymeric binder system of low viscosity, and one that does not contain lead and has a low enough level of free formaldehyde so as to not require it to be considered carcinogenic. This system allows for binding of the particulates and shaping them into a desired form, such as a pillow briquette, without the need for the typical long cure period of 24 hours. The resulting briquette has less than about 3% binder by weight of the briquette.

Specifically, the briquettes are produced by charging the binder-particulate mixture into forming equipment, such as a typical briquetting press, in a manner that the fines and the liquid binder components are intimately mixed to create a polymeric matrix in which the particles are "locked". To achieve this "locked" state, two steps must occur sequentially in a very precise time frame. The importance of the time frame cannot be overstated. If the forming operation takes place too soon, the resultant briquette has poor green strength, if it takes place beyond the time of initial set, the binder actually resists the briquetting operation, resulting in a weak briquette. First, intimate mixing between particulates and the binder components should occur. Then, the shaping operation, or briquetting, should occur precisely at the moment of incipient cure.

It has already been mentioned that bonding of particulates with a liquid binder must conform to a surface area balance. This requires that the binder particles be delivered in the form of a relative particle size that is much smaller than the particle size of the material being bonded. Thus, the goal is to fractionate or atomize the binder into as small a particle size as possible. The binder components are formulated to have low viscosity which makes them amenable to atomization. Clearly, the thinner the liquid binder or lower the viscosity of the liquid binder, the more easily this is accomplished. However, lowering the viscosity should not be accomplished by simply adding solvents. This reduces the solids content and reactivity. In the binder used in present invention, the resin viscosity was not lowered at the expense of reactivity.

Once the binder is atomized, the intimate mixing of binder and fines is achieved through delivering a fine mist of the atomized binder components into the fines or particulates that are in a highly agitated or fluidized state. This is accomplished by using a high speed mixer that fluidizes the particles on one hand, and injects the binder components, through special fog nozzles, directly into the particulates, on the other. This ensures a uniform and intimate binder particulate mixture. Once the binder is uniformly mixed with the particulates, the mixture is discharged into a delay box where it is held in continuous motion until the moment of incipient cure, as mentioned earlier.

More specifically, the gel time, or the initial set time, of a neat binder system such as that disclosed herein, is typically under 150 seconds at 75° F. Of course, the initial set achieved in a binder-particulate combination is dependent on the particulate material involved. Since mixing time is determined by the mixing equipment, a special mechanism or the delay box is herein disclosed to build a "delay" into the process in such a way that the residence time of the binder-particulate mixture in the high speed mixer, together with the residence time in the delay mechanism, equals the time of initial set. Consequently, the mixture is at a point of incipient cure as it is discharged from the delay box into the forming/shaping equipment, such as a briquetting press.

It is important to recognize that the polymeric curing process just discussed goes through three stages. In the first stage, all of the binder components are in a liquid state. Upon mixing, the process of cross-linking begins and the material goes through a "plastic" or the second stage. The third stage, which is a final and hardened or cured stage is achieved shortly thereafter. In the case of the binder used in the present invention, the plastic stage is extremely short-lived but a nonetheless critical one since only in this stage is the material amenable to shaping or forming. The forming has to be completed in the "plastic" stage, otherwise the quality of the resulting agglomerate is poor. Hence, the criticality of the time frame.

Continuing, the mixture is discharged from the delay box at the opportune moment, into the briquetting press where it is formed and dropped on a heated conveyor belt on which it travels about three minutes before it drops into a holding container. The briquettes are strong enough at this point for handling, transportation, and use.

Pretreatment of Ultrafine Materials

The foregoing works well in the case of particulates in the −4 mesh to +100 mesh range. If, however, the particulates contain more than 10% material of ultrafine size, or smaller than 225 mesh, the total surface area is such that it cannot be covered by using small quantities of binder. A special pretreatment step is employed prior to the agglomeration process described earlier to make the ultrafine dust more amenable to bonding. The pretreatment is carried out by passing the ultrafines through a pin mixer where a hydrophobizing organosilane solution is sprayed on the dust.

Three objectives are realized in the pretreatment steps. They are: 1) to increase the particle size and reduce the overall surface area; (2) to make the dust more amenable to bonding since organosilane also acts as an adhesion promoter with the organic resin; and, (3) to make the dust hydrophobic so that it flows through the process without caking.

The general formula of an organosilane shows two classes of functionality:

$$R_nSiX_{(4-n)}$$

The X group is involved in the reaction with the inorganic substrate, which in this case is the ultrafine dust. The bond between X and the silicon atom in coupling agents is replaced by a bond between the inorganic substrate and the silicon atom. X is a hydrolyzable group, typically, alkoxy, acyloxy, amine, or chlorine. The most common alkoxy groups are methoxy and ethoxy, which give methanol and ethanol as by-products during coupling reactions. Since chlorosilanes generate hydrogen chloride as a by-product during coupling reactions, they are generally less utilized than alkoxysilanes.

The most common application for silane coupling agents is to bond an inorganic substrate to a polymer. This may be depicted as follows:

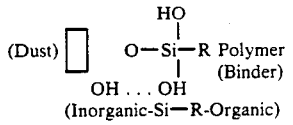

The number of hydrolyzable X groups on the silane is another important parameter in controlling bond characteristics. The traditional silane coupling agents contain three hydrolyzable groups. They have maximum hydrolytic stability, but tend to be hydroscopic. At the opposite end are the silanes with one hydrolyzable group. These yield the most hydrophobic interfaces, but have the least long term hydrolytic stability. Consequently, silanes with one hydrolyzable group are used in the present invention, including but not limited to, aminopropyl trimethoxy silane and other such silanes.

Method of Application

Deposition from aqueous alcohol solutions is the most facile method for preparing silated surfaces. A 95% ethanol-5% water solution is adjusted to pH 4.5–5.5 with acetic acid. Silane is added with stirring to yield a 2% final concentration.

For less soluble silanes 0.1% of a non-ionic surfactant is added prior to adding silane. Bulk deposition on dust is usually accomplished by a spray-on method. It assumes that the total amount of silane necessary is known and that sufficient adsorbed moisture is present on the filler to cause hydrolysis of the silane. The silane is prepared as a 25% solution in alcohol. The powder is placed in a high intensity solid mixer, e.g. twin cone mixer with intensifier or a pin mixer. The solution is pumped into the agitated powder as a fine spray. In general, this operation is completed within a few minutes. The pretreated dust is then introduced in the regular process described earlier.

Binder Systems

The binder systems are organic polymers that can cure or crosslink in under 5 minutes at room temperature, i.e. 77° F.±2° F. These may include but are not limited to epoxies, polyesters, alkyds, and phenolic urethanes, specially formulated to meet the above general criteria. These binder systems can be two or three component systems that are not required to be disclosed as cancer-causing as per the current EPA guidelines. The viscosity of the combined binder components should not exceed 200 cps and should have a minimum solids content of 50%.

The binder system used in the present invention is a 3 component system, although others, as mentioned above, can be acceptable. The preferred 3 component system according to the subject invention is a binder system such as the Delta Set system commercially available from Delta Resins and Refractories or Pep-Set Binder Systems commercially available from Ashland Chemical. Such systems typically include a phenolic resin, a polyisocyanate-based co-reactant and an amine catalyst. Typical two-part systems such as epoxy or bis-phenol A resins do not require the addition of the activator or catalyst mentioned above.

Equipment

The line diagram of FIG. 1 assumes a two component briquette containing fines received in receiving bin 1 through surge hopper 2*a* and ultrafines from surge hopper 2*b*. This situation is often encountered in metallurgical process where there is a growing interest in recycling the baghouse dust (ultrafines) by mixing it with metallics from another waste stream, also available on site. A typical case from an integrated steel mill would be that of briquetting a mixture of electric arc furnace dust (containing zinc, lead, etc.) from hopper 2*b* and millscale fines from hopper 2*a*. In case of stainless steel industry, it would be a mixture of stainless electric arc furnace dust (containing valuable nickel and chrome) from hopper 2*b* and stainless grindings from hopper 2*a*. There is interest not only in recovering metals through recycling, but also in averting the cost of disposing of the electric arc furnace dust which is very expensive presently and will only get more so in the future.

Where there is only a single material briquetting, the second component hardware, including hopper 2*b*, silane solution tank 4, and pretreatment mixer 5, can be left out.

A given amount of fines are discharged from the surge hopper 2*a*, by conveyor belt 12 to a dryer 3. From the dryer 3, if used, or from the hopper 2*a* if the dryer is not used, the fines are discharged into the high speed mixer 7. Simultaneously, the proper amount of ultrafines are delivered into pretreatment mixer 5 where the ultrafines are pretreated with silane from tank 4 in a continuous operation and discharged via conveyor 14 into the same high speed mixer 7. The conveyor belts 13 and 14 can optionally be enclosed conveyor belts in case the dusts being handled are "lifted" or hazardous dusts. Such conveyor belts are sold by Omni-Lift, Inc., among others. The dust and fines, while in a highly agitated and fluidized state, get evenly coated with the binder components sprayed into high speed mixer 7 through commercially available fog nozzles connected to lines 6*a*, 6*b* and 6*c* from binder tank 6. The mixed material is then discharged in the delay box 8 to match the proper time for initial set. Then, at the opportune moment, the mixed material is discharged into the standard briquetting press 9 where briquettes are formed and dropped onto a heated conveyer belt 15 which is maintained at 180° F. on Which the briquettes travel for about three minutes. From conveyor belt 15 the cured briquettes drop into the briquette collection bin 10. The briquettes are ready at this point for handling, transportation and use. Total processing time, from hoppers 2*a* and/or 2*b*, is not more than about 5–7 minutes.

EXAMPLE 1

High carbon ferrochrome fines were supplied by Union Carbide. The fines were −8 mesh in size. Time output of the screw conveyer was measured at 120 lbs/min. The binder components pumps were calibrated to maintain the feed rate of approximately 1% total binder percentage by weight or 0.6 lb. each of resin and co-reactant per minute. The activator pump was set at a number "five" setting and delivered 0.03 lb/min. directly into the resin stream. These flow rates were verified by actual check on weights through the bypass lines. Upon measuring the amounts, all the components were mixed in a cup to verify complete cure as well as the set time.

The actual set time of the binder and ferrochrome fines was measured at 130 seconds. The delay box timer was adjusted to 120 seconds since the residence time in the mixer was known to be 10 seconds.

The briquetting machine was set at 1,900 psi pressing force. Feed screw was set at 2. All systems were turned on and the briquetting performed.

The invention has been described with reference to the preferred embodiment. Obviously, modifications and alterations will occur to others upon a reading and understanding of this specification. It is intended to include all such modifications and alterations in so far as they come within the scope of the appended claims or the equivalents thereof.

Having described the invention, the following is claimed:

1. A method for briquetting fines and ultrafines comprising mixing said fines and ultrafines on a continuous basis with a binder system having low viscosity of up to about 200 cps and at least 50% solids, such that the resulting briquette contains less than about 1% but greater than 0% binder by weight of the briquette.

2. The method of claim 1 wherein said briquettes are produced in less than about 10 minutes.

3. The method of claim 1 wherein said ultrafines are pretreated with silane prior to mixing with said binder.

4. The method of claim 1 wherein said binder system is a 3-part system comprising a phenolic, a polyisocyanate-based co-reactant and an amine catalyst.

5. The method of claim 1 wherein said binder system is a 2-part system selected from the group consisting of epoxy resins a bis-phenol A resins.

6. A continuous process for producing briquettes from fines comprising:

discharging said fines into a high speed mixer;

discharging the components of a binder system into said high speed mixer through fog nozzles simultaneously with said discharge of said fines;

agitating said binder and said fines to produce a homogeneous binder-fines mixture;

discharging said homogeneous binder-fines mixture into a delay box for a period of time such that said mixture is at the point of incipient cure;

discharging said mixture at said point of incipient cure into a briquetting press and forming briquettes therefrom;

discharging said briquettes onto a heated conveyor for a period of not longer than 4 minutes to cure said briquettes; and, collecting said cured briquettes containing less than about 1% but greater than 0% binder by weight of the briquette.

7. The process of claim 6 wherein ultrafines are discharged into said high speed mixer simultaneously with said fines.

8. The process of claim 7 wherein said ultrafines are pretreated prior to discharge into said high speed mixer.

9. The process of claim 8 wherein said pretreatment includes exposure of the ultrafines to an organosilane solution.

10. The process of claim 6 wherein said binder system is a 3-part binder system.

11. The process of claim 10 wherein said 3-part binder system comprises a phenolic resin, a polyisocyanate-based co-reactant and an amine catalyst.

12. The process of claim 6 wherein said binder system is a 2-part system.

13. The process of claim 12 wherein said 2-part binder system comprises an epoxy resin.

14. The process of claim 12 wherein said 2-part binder system comprises an bis-phenol A resin.

15. The process of claim 6 wherein said binder system has a viscosity of not more than about 200 cps.

16. A process for pretreatment of ultrafines comprising discharging said ultrafines into a pretreatment mixer and exposing said ultrafines in said pretreatment mixer to an organosilane solution.

* * * * *

UNITED STATES PATENT AND TRADEMARK OFFICE

CERTIFICATE OF CORRECTION

PATENT NO. : 5,302,341

DATED : April 12, 1994

INVENTOR(S) : Palowitz et al.

It is certified that error appears in the above-identified patent and that said Letters Patent is hereby corrected as shown below:

Title Page, Item [54], the title of the invention is incorrect. At line 2, "CONTAINS" should read --CONTAINING--.

Signed and Sealed this

Second Day of August, 1994

*Attest:*

*Attesting Officer*

Bruce Lehman

BRUCE LEHMAN

*Commissioner of Patents and Trademarks*